US006557309B1

(12) United States Patent
Johnson

(10) Patent No.: US 6,557,309 B1
(45) Date of Patent: May 6, 2003

(54) JAMB ASSEMBLY

(76) Inventor: Flint Scott Johnson, 8027 9th St. Way North, Oakdale, MN (US) 55128

( * ) Notice: Subject to any disclaimer, the term of this patent is extended or adjusted under 35 U.S.C. 154(b) by 0 days.

(21) Appl. No.: 09/628,482

(22) Filed: Jul. 31, 2000

(51) Int. Cl.[7] ..... E06B 1/04
(52) U.S. Cl. ..... 52/210; 52/215
(58) Field of Search ..... 52/210, 211, 212, 52/215, 204.53, 204.54, 204.1

(56) References Cited

U.S. PATENT DOCUMENTS

| | | | | | |
|---|---|---|---|---|---|
| 403,573 | A | * | 5/1889 | Boda | 52/212 |
| 2,727,284 | A | * | 12/1955 | Adams et al. | 52/210 |
| 4,019,303 | A | | 4/1977 | McAllister | 52/745 |
| 4,126,975 | A | | 11/1978 | Williams | 52/211 |
| 4,180,944 | A | | 1/1980 | Stowik et al. | 49/504 |
| 4,296,299 | A | | 10/1981 | Nelson | 49/504 |
| 4,330,972 | A | | 5/1982 | Sailor | 52/211 |
| 4,631,866 | A | | 12/1986 | Otto et al. | 49/504 |
| 5,575,123 | A | | 11/1996 | Adams | 52/212 |
| 5,634,303 | A | | 6/1997 | Ellingson | 52/210 |
| 6,155,011 | A | * | 12/2000 | Robertson | 52/212 |
| 6,378,266 | B1 | * | 4/2002 | Ellingson | 52/210 |

* cited by examiner

*Primary Examiner*—Michael Safavi
(74) *Attorney, Agent, or Firm*—Jacobson & Johnson

(57) ABSTRACT

A door jamb assembly having a interchangeable multi-component design allowing for the framing of doorways with different configurations by first selecting a main frame and a decorative trim that conforms with the doorway and then securing the first end of the main frame, being attached to the decorative trim, onto a wall with the use of an attachment flange and securing the second end of the main frame to an interior jamb with the use of a fastener.

9 Claims, 4 Drawing Sheets

JAMB ASSEMBLY

FIELD OF INVENTION

This invention relates generally to door jambs, and more specifically to a door jamb assembly having a multi-component design allowing for customizability by combining the various components for each specific order such as color, doorway size, or exterior trim style.

BACKGROUND OF THE INVENTION

The present invention is a doorjamb assembly having an interchangeable multi-component design allowing for customizability of each individual doorway by combining various components. Each differences in configuration of each doorway(such as size, wall width, trim design, etc., can be specifically ordered and attached to the door jamb assembly as to conform not only with the doorway but also the thickness of the wall. In addition, once installed, the doorjamb assembly requires no further finishing. If the door jamb is composed of a material such as high density polyurethane the assembly will also likely be maintenance free. In addition the door jamb assembly can be mated with itself to provide for a sash support.

BRIEF DESCRIPTION OF THE PRIOR ART

U.S. Pat. No. 5,634,303 discloses an improved door jamb and brickmold assembly having a wooded or plastic jamb and a unitary extruded thermoplastic brickmold and stop.

U.S. Pat. No. 4,631,866 discloses an improved door jamb construction adapted to be used with left or right-handed door installations.

U.S. Pat. No. 4,295,299 discloses a door frame constructed primarily of wood, and having a metal cladding surrounding a portion of the frame.

U.S. Pat. No. 4,330,972 discloses a door frame for mounting pre-hung doors in door openings of an existing structure.

U.S. Pat. No. 5,575,123 discloses a vinyl door frame assembly.

U.S. Pat. No. 4,180,944 discloses a door jamb made of a plurality of sections which are maintained together in a rigid stable frame.

U.S. Pat. No. 4,019,303 discloses a process for making an adjustable split door frame.

U.S. Pat. No. 4,126,975 discloses a casing construction for secure mounting in wall openings.

SUMMARY OF THE INVENTION

Briefly, the present invention comprises a door jamb assembly having a main frame having a face, a first end and a second end providing for the attachment of a door jamb thereto by a fastener. Protruding from the first end of the main frame is an extension for engaging a portion of a decorative trim. A seal can be connected to the face of the extension to provide a weatherproof seal with the decorative trim. Extending from the second end of the main frame and sufficient to overlap a portion of a door jamb is a lip. Located within the door jamb assembly is a member for securing an attachment flange. The attachment flange, once connected to the member then secures the door jamb assembly onto a wall.

DESCRIPTION OF THE PREFERRED EMBODIMENT

Figure 1:
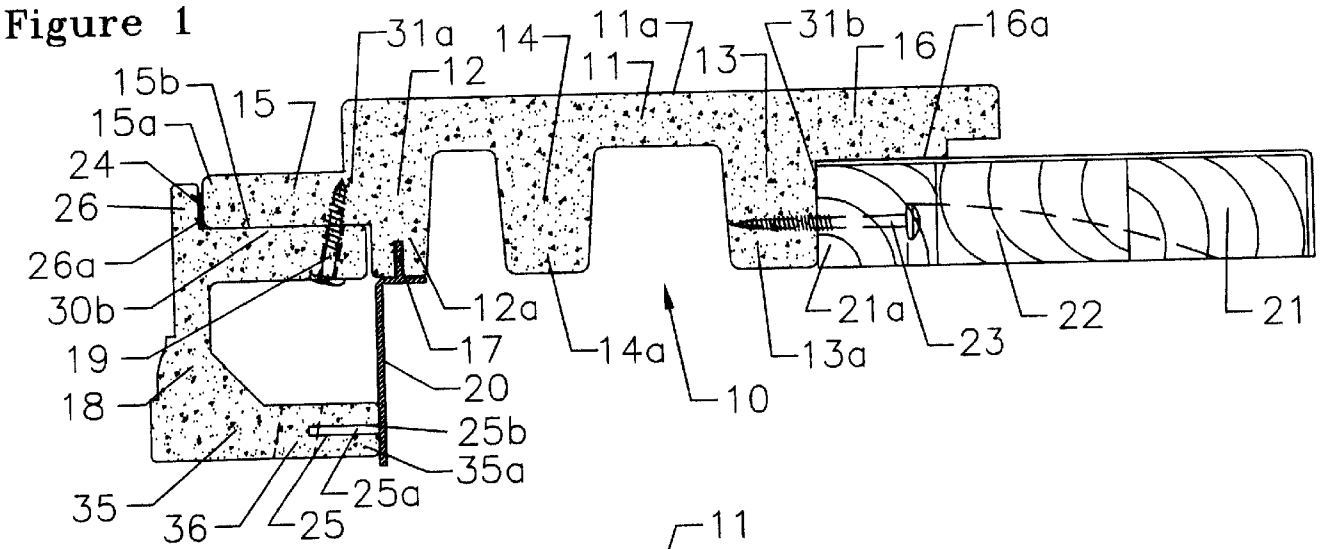
FIG. 1 shows a cross-sectional view of a door jamb assembly with a nailing flange secured to the main frame.

FIG. 1 shows a cross-sectional view of a door jamb assembly 10 that embodies es the present invention in the preferred form. The complete assembly of the present invention comprises four parts, a main frame 11, an interior door jamb 21, a decorative trim 18, and a hinged nailing flange 20. The end-two-end combination of these parts encompasses a doorway opening on the sides and top to create a substantially maintenance free decorative finish.

Door jamb assembly 10 comprises an elongated main frame 11 preferably composed of high density polyurethane but can also be made out of wood or the like. The advantage of using high density polyurethane is that the it can be cut to size much like wood and it requires little if any maintenance. Main frame 11 has a smooth face 11*a* which provides for a decorative looking surface, a first main frame end 31*a* for attachment of decorative trim 18 thereto, and a second main frame end 31*b* which provides for the cantilevered attachment of a jamb 21 by a screw fastener 23.

Protruding outward from the first end 31*a* of main frame 11 is a main frame extension 15 having an end 15*a* for engaging a portion of a trim 18 to create a weather proof seal and a face 15*b* to provide for the attachment of trim 18 by a screw fastener 19. Extending from the second end 31*b* of main frame 11 is a main frame lip 16 having a jamb engaging face 16*a*. Main frame lip 16 extends sufficiently to overlap a portion of door jamb 22 with the door jamb 22 cantileverly attached to end 31*b* by screw fastener 23.

In the embodiment of FIG. 1 main frame 11 has a first main frame leg 12 having a wall engaging end 12*a* located proximate to end 31*a* of main frame 11, a second leg 13 having a wall engaging end 13*a* located proximate to end 31*b* of main frame 11, and a third leg 14 having a wall engaging end 14*a* which is located between the first leg 12 and the second leg 13 of main frame 11. Located at the end 12*a* of first leg 12 is a first member 17 comprising a slot having parallel spaced sidewalls 17*a* and 17*b* extending inwardly for securing a nailing flange thereto. Although the preferred embodiment calls for three legs, there can be more than and less than three legs.

Securely attached to main frame 11 at the second main frame leg 13 by a screw fastener 23 is interior jamb 21 having an interior jamb end 21*a*. Interior jamb 21 is composed of a veneered lumber core to provide a finished look that does not require further finishing; however, if desired interior jamb 21 can also be made out of other materials such as wood and plastic. Located proximate to end 21*a* of interior jamb 21 is a recess 22 which allows interior jamb end 21*a* to be secured to main frame 11 by first fastener 23 which extends lengthwise along jamb 21 and into leg 13. As can be seen the jamb 21 and main frame 11 extend in a straight line for placement against one side of a building wall. Jamb 21 is secured to main frame 11 in an end to end fashion in a method described in my U.S. Pat. No. 5,485,708 which is incorporated herein by reference.

Securely attached to main frame 11 at extension 15 by second fastener 19 is decorative trim 18 having a decorative exterior face 18*a*. Decorative trim 18 is composed of high density polyurethane to provide a weather resistance trim due to polyurethane's durable weather resistant qualities; however, if desired decorative trim 18 can also be composed of other materials such as wood. The embodiment of FIG. 1 shows decorative trim 18 has a first trim leg 30 having an end 30*a* and a support face 30*b* which is secured to face 15*b* of main frame extension 15 by screw fastener 19, and a second trim leg 35 having an end 35*a*. While the embodiment of FIG. 1 shows two legs there can be more than and less than two legs on decorative trim 18. Located on leg 30 is a fastener guiding hole 37 which maintains a fastener, such as a screw fastener, in position to pull decorative trim 18 into engagement with main frame 11. Aligned with fastener guiding hole 37 on second leg 35 is a fastener access hole 36. Fastener access hole. 36 allows an operator to quickly secure a fastener such as a screw fastener 37 when the screw fastener has been pre-placed within fastener guiding, hole 15 and ready for securement. That is, the fastener guiding hole has a diameter that is sufficiently small so that the screw fastener 37 engages the sidewalls of the fastener guiding holes to frictionally hold screw fastener 37 in a ready to apply condition. The installer need not spend time inserting the fastener since the decorative trim 18 can be sent from the factory with the screw fastener 37 in place for quick installment. Also located on second trim leg 35 is a second member 25 comprising a slot having parallel sidewalls 25*a* and 25*b* for securing a fastening flange such as a nailing flange thereto.

Protruding at a right angle to trim leg 30 is a trim lip 26 having a face 26*a* sufficient to overlap a portion of main frame 11. Attached to the face 26*a* of trim lip 26 is a foam tape 24 having an adhesive on one side for securing foam tape 24 to face 26*a* of trim lip 26. Foam tape 24 is composed of a closed cell foam that is compressible and water resistant and forms a weather proof seal when trim lip 26 engages with a portion of main frame 11. Thus with the use of a weather seal the main flame 11 and trim 18 can be sealed to each other to prevent moisture penetration therebetween.

As shown in FIG. 1 secured by first member 17 is a hinged nailing or fastening flange 20. Flange 20 comprises a nailing flange, which is composed of a rigid vinyl, that is connectable either to first member 17 or second member 25 to secure the door jamb assembly to the wall. Nailing flange 20 is a commercially available product and is described in U.S. Pat. No. 4,821,472.

With the embodiment of FIG. 1 the present invention provides for two surface support for both jamb 21 and trim 18. That is, jamb 21 is supported on end 21*a* and surface 21*b* by main frame 11. Similarly, trim 18 is supported on extension surface 15*b* and on extension end 15*a* of main frame 11. Main frame 11 and jamb 21 thus provide an elongated section for placing against a first wall while the trim 18 provides an angular protrusion for engaging against a second wall with the trim supportable by the main frame and the entire assembly 10 supportable by a fastening flange securable to either the main frame 11 or the trim 18.

Figure 2:
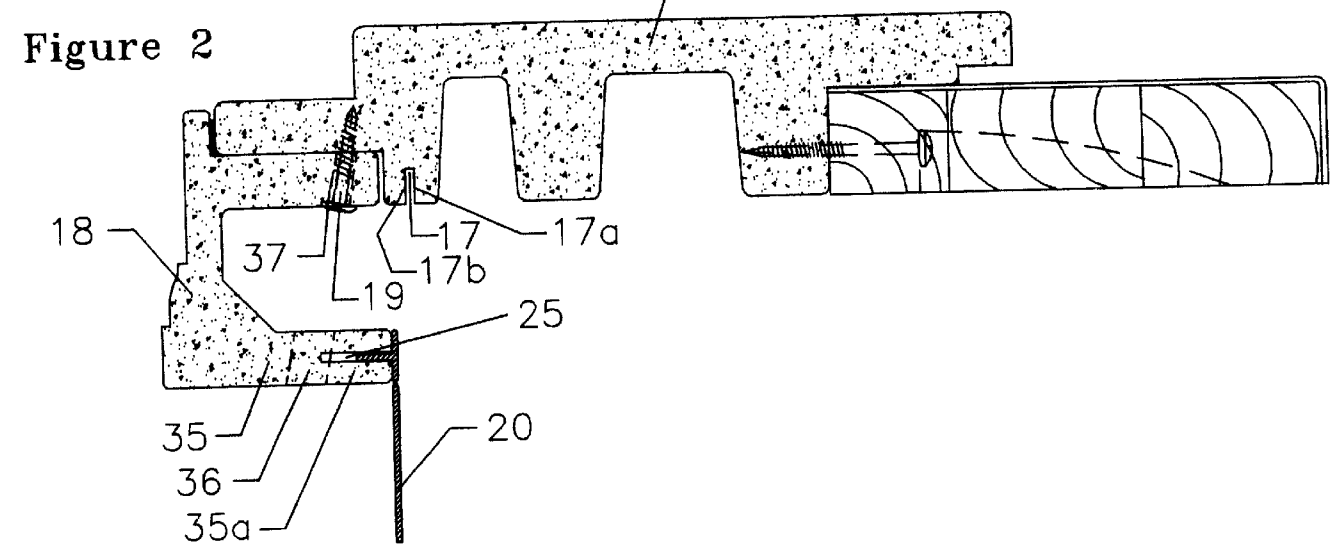
FIG. 2 shows a cross-sectional view of a door jamb assembly with the nailing flange secured to the trim.

FIG. 2 shows a cross-sectional view of a door jamb assembly 10 which is almost identical to FIG. 1 except that nailing flange 20 is secured by second member 25 instead of first member 17. The ability to secure nailing flange 20 either at first member 17 or second member 25 provides flexibility in mounting door jamb assembly 10. Placing nailing flange at first member 12 allows the operator to secure main frame 11 to a wall before having to choose a decorative trim. For trims with wide widths, placing nailing flange 20 at first member 12 also allow the trim to hide the fasteners used to secure nailing flange 20 to the wall. On the other hand, placing nailing flange 20 at second member 25 allows the operator to secure the door jamb assembly 10 as a unit to a building wall by nailing through flange 20 and into the building wall. One of the features of the present invention is that the trim leg 36 can be cut to sufficient length to engage a wall board. Thus the amount of inventory of trim can be reduced because the trim can be cut to fit different thickness wallboards.

Figure 3:
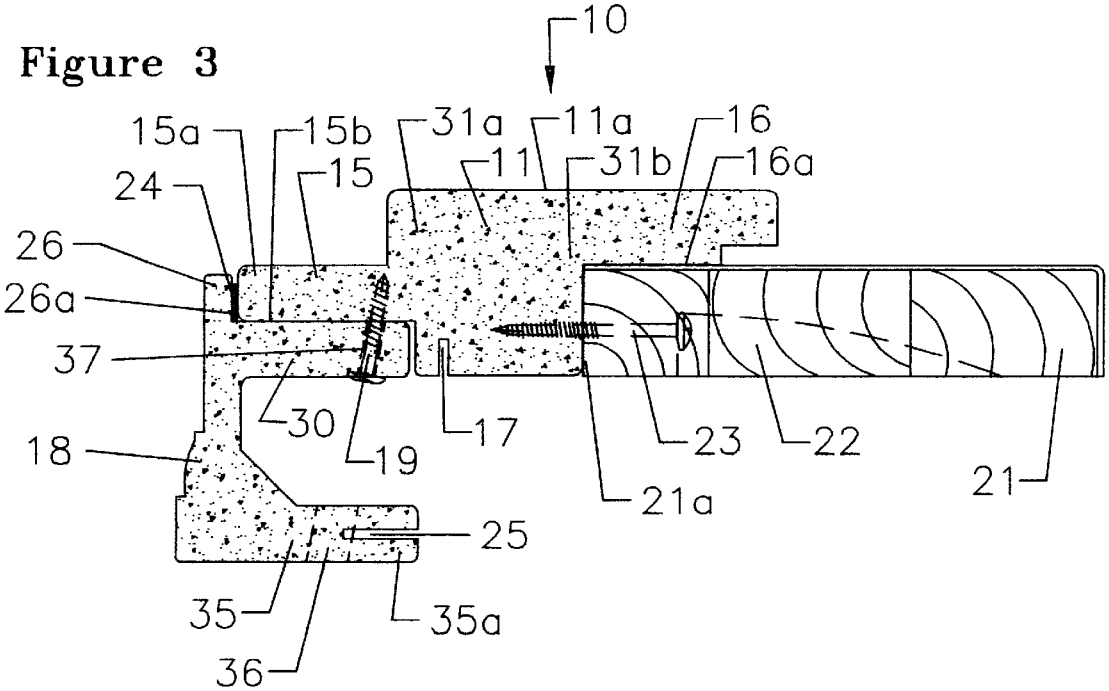
FIG. 3 shows a sectional view of a door jamb assembly with the main frame having no leg.

FIG. 3 shows a cross sectional view of a door jamb assembly similar to FIG. 2 except that main frame 11 does not have any legs. The first member for securing nailing hinge 20 is located proximate first end 31*a* of main frame 11. This embodiment could be used for doorways that tend to be narrow in width.

Figure 4:
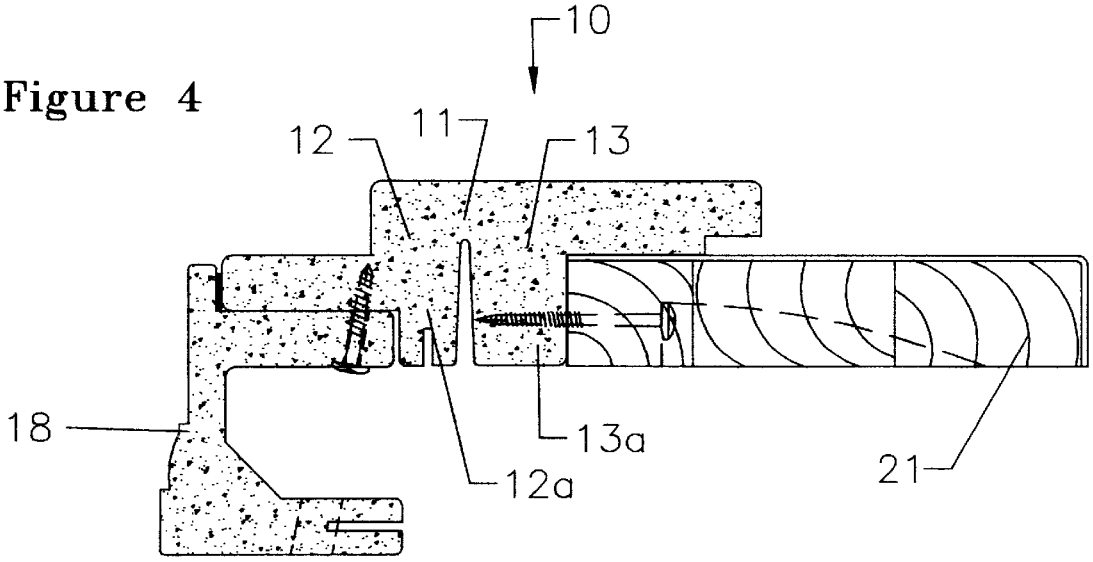
FIG. 4 shows a cross-sectional view of a door jamb assembly with the main frame having 2 legs.

FIG. 4 shows a cross sectional view of a door jamb assembly similar to FIG. 2 except that main frame 11 has two legs instead of three. This embodiment can be used for doorways that have a width longer than the embodiment with no legs as in FIG. 3 but shorter than the embodiment with three legs as is shown in FIG. 2.

Figure 5:
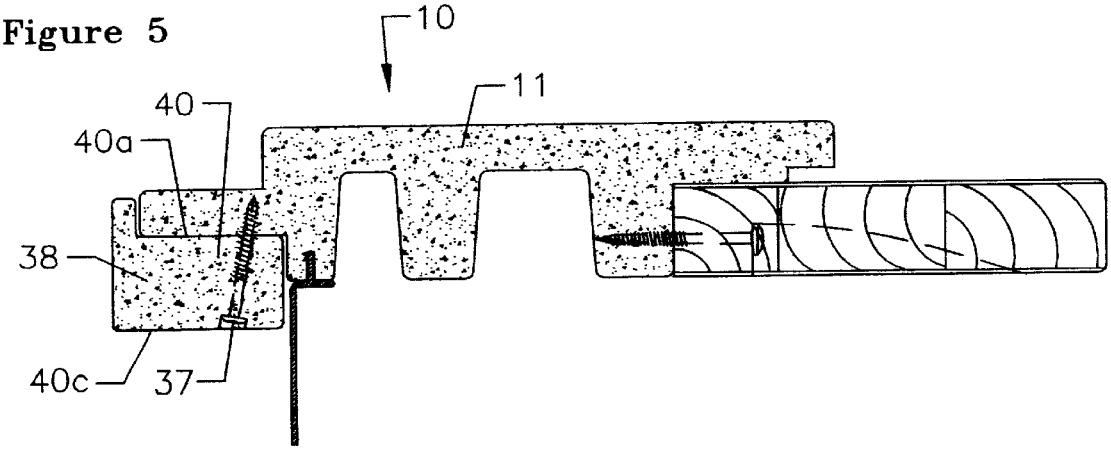
FIG. 5 shows a cross-sectional view of a door jamb assembly with the decorative trim only having one leg.

FIG. 5 shows a cross sectional view of a door jamb assembly similar to FIG. 2 except that decorative trim 38 has one leg 40. The use of this embodiment is ideal in situations where the doorway is located proximate the corner of a room in which there would not be room to have wider trims or if the user desired a narrower trim. In the embodiment of FIG. 5 the decorative trim includes a screw fastener 37 which is frictionally held in leg 40 in a recessed condition so that the head of screw fastener is located below surface 40*c*.

Figure 6:
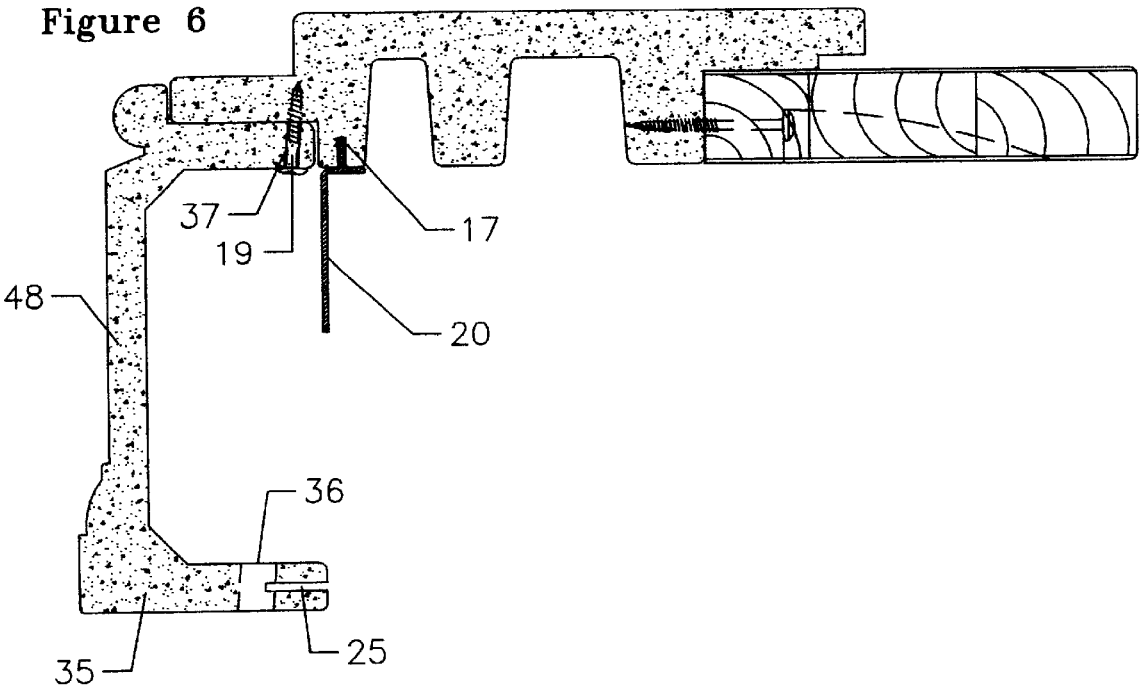
FIG. 6 shows a cross-sectional view of a door jamb assembly with the decorative trim having a long embodiment.

FIG. 6 shows a cross sectional view of a door jamb assembly similar to FIG. 2 except that a different decorative trim 48 which is wider than the decorative trim 18 embodiment in FIG. 2. The use of this embodiment is ideal in situations where the user wants to hide nailing flange 20 after nailing flange 20, placed at first member 17, has been used to secure the door jamb assembly to the wall since decorative window trim 18, in this embodiment, is wider than nailing flange 20. In addition, since decorative trim 18 is wider than the embodiment in FIG. 2, the additional width provides for extra space for additional art work on the trim. Thus it will be appreciated that with the present invention the door jamb assembly can be construed of many different shapes and sizes through the use of only a few components thereby minimizing the inventory of components for the fabricator.

The flexibility of being able to use different type of trims in the door jamb assembly is one of the great advantages of the present invention because it provides the operator the advantage of being able to place a trim on almost all types of doorways, even on doorways which may be located close to the corner of a building. In addition, the operator can also choose from a variety of trim decorations to blend in with the surroundings of the building.

Figure 7:
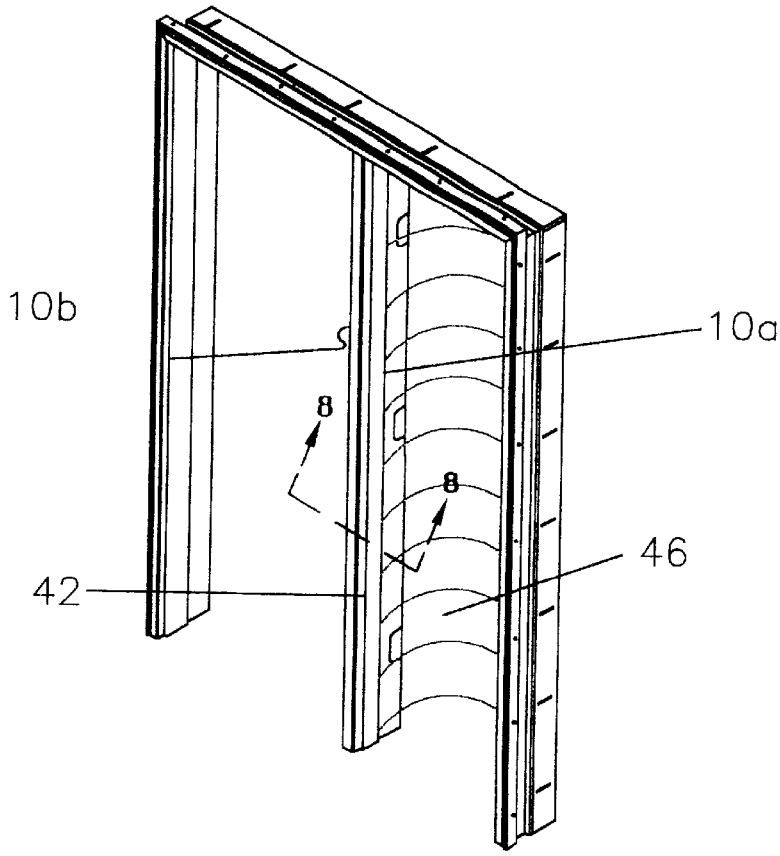
FIG. 7 shows a perspective view of a doorway frame with a side light.
Figure 8:
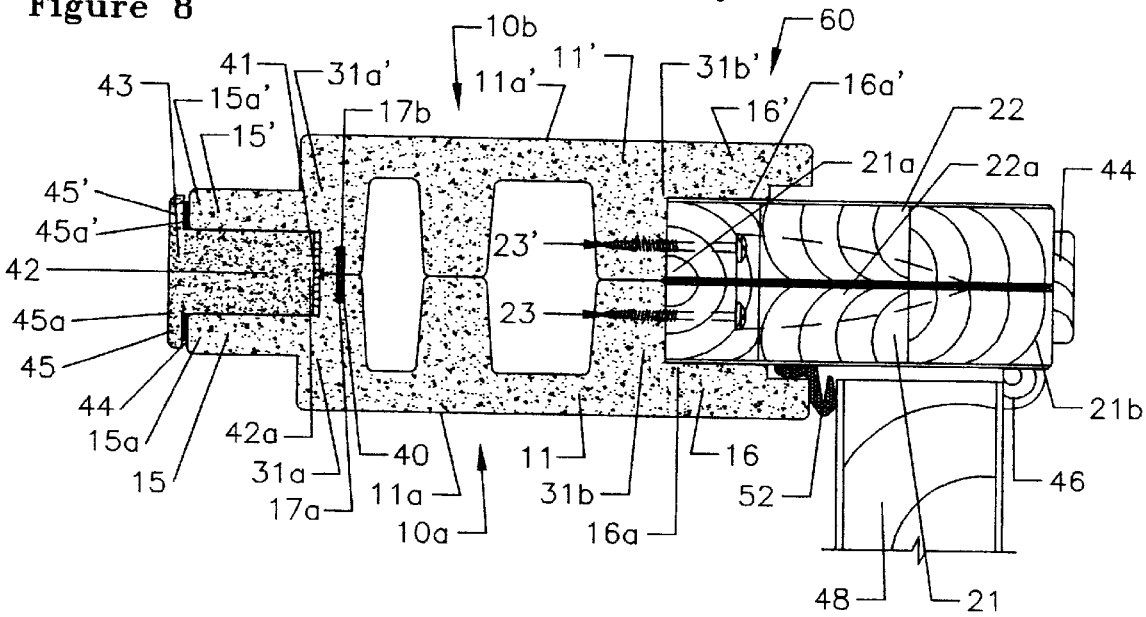
FIG. 8 shows a cross-sectional view taken along the lines 8—8.

FIG. 7 shows a perspective view of a doorway frame with a sidelight wherein the door jamb assembly that is used for the door frame is also used to support a sash and FIG. 8 shows the double door jamb assembly 60 as both a door support and a window sash support. FIG. 8 is a cross sectional view taken along the lines 8—8 showing the attachment of first door jamb assembly 10*a* and second door jamb assembly 10*b*. In this embodiment a first door jamb assembly 10*a* and a second door jamb assembly are secured together to give support for both the sidelight panel 46 and the door. A mull cap 42, preferably composed of polyurethane but can also be made out of other materials such as wood or the like, is attached to the outside of the frame to provide for a decorative finish.

FIG. 8 shows the two assemblies are attached in such a way that the end faces of their legs are engaging each other. Securely connecting the two assemblies 10*a* and 10*b* together is a mull spline 40 composed of vinyl. Mull spline 40 is attached at the first member 17*a* of first door jamb assembly 10*a* and at the first member 17*b* of second door jamb assembly 10*b*. The attachment of the two assemblies 10*a* and 10*b* create a recess 42 located between the extensions 15 and 15' of the two assemblies. A caulk 41 is then applied to the end 42*a* of recess 42 to seal the connection between the two assemblies 10*a* and 10*b*.

A mull cap trim 43 is then fit into recess 42 with lips 45 and 45' of mull cap trim 43 engaging end 31*a* and 31*a'* of the main frame extensions. Mull cap trim 43 is preferably composed of high density polyurethane since it can be readily machine and is resistant to moisture penetration thus will not rot but other materials such as wood or the like can be used. The use of mull cap trim 43 not only hides the connection made between the two assemblies but also provides for a decorative finish to the exterior of the side light mull. Securing mull cap trim 43 to the end of the main frame extensions is a double sided tape 44 and 45'. Tape 44 and tape 45' are compressible and water resistant and creates a waterproof seal between the connection of mull cap trim 43 to the door jamb assemblies.

Located at the second end of the interior jambs 21 and 22 is a decorative mull casing 44. Mull casing 44 is preferable composed of wood but can be made from other materials such as high density polyurethane and can be attached to the second end of the interior jamb by an adhesive or other type of fastener. Attachment of mull casing 44 not only secures the jambs but hides the junction of the interior jambs by the connection of the two assemblies but also provides for a decorative finish for the interior ends of the door jamb assemblies 10*a* and 10*b* which form side light mull 60.

Located at a right angle to the second end 21*b* of first interior jamb 21 is a side light sash stop 46. Sash stop 46 is preferably composed of wood but other materials such as polyurethane can be used and can be attached to interior jamb 21 by an adhesive. The function of sash stop 46 is to secure a side light panel 48 in place when side light panel 48 engages door jamb 21. Located on the opposite end of sash 48 is a second sash support 52 that resiliently supports and cushions window sash 48 against main frame 11. Although there are two interior jambs shown in this embodiment, the side light mull assembly 60 can be made with one interior jamb of wider width if desired; however the use of interior jambs that are also used for the door jamb allows for the fabricator to maintain a minimum of components.

The present invention can thus be used for a doorway trim by securing the door jamb assembly onto a wall or can be used as a side light mull by the use of two main frames securely engaging each other.

In the method of assembly a fabricator secures a door jamb to a main frame 11 in an end-to-end condition with at least two surfaces of the main frame engaging door jamb 21. The user can then secure the door jamb 21 and main frame 11 against a building wall. Once secured against a wall the user can select and attach a decorative trim 18 to the main frame to thereby secure the door jamb assembly as a unit to the building wall.

In the step of securing a fastening flange the user can place a nailing flange in either the main frame 11 or the decorative trim 18 and fasten the nailing flange to the building wall.

In the step of securing the door jamb 21 to the main frame 11 the fabricator extends a screw fastener 23 through an end of the door jamb 21 and into an end 31*b* of the main frame 11.

In the step of attaching the decorative trim 18 the fabricator laterally secures a leg 30*a* of the decorative trim 18 with a screw fastener 19 with the screw fastener concealed from frontal view.

In order to make the door jamb assembly rigid and self supporting the main frame 11 is made from a first material and the door jamb 21 is made of a second rigid material. The attachment of the two material to each other provides additional rigidity to the combination which enables the main frame 11 and door jamb 21 to form a unitary rigid elongated member for placing against a building wall.

I claim:

1. A high density polyurethane door jamb assembly comprising:

a main frame body, said main frame body composed of high density polyurethane;

a first main frame leg composed of high density polyurethane, said first main frame leg having an end;

a second main frame leg composed of high density polyurethane, said second main frame leg having an end;

a third main frame leg composed of high density polyurethane, said third main frame leg having an end;

a main frame extension composed of high density polyurethane, said main frame extension protruding at a right angle from said first main frame leg, said main frame extension having a main frame extension end and a face for engaging a surface;

a main frame lip composed of high density polyurethane, said main frame lip having main frame lip end and a main frame lip face, said main frame lip extending at a right angle to said third main frame leg sufficient to overlap a portion of a door jamb;

a decorative trim having a first leg and a second leg;

a member for securing a hinge flange, said member located at the end of said first main frame leg or located at an end of said first decorative trim leg;

a decorative trim lip, said decorative trim lip having a face sufficient to overlap a portion of said main frame;

a decorative trim fastener guiding hole located on an end of said second decorative trim leg, said decorative trim fastener guiding hole allowing said decorative trim to be laterally connected to said main frame with a screw; and an interior jamb having a first end and a second end, said interior jamb having a recess located proximate to the first end of said interior jamb to allow a user to secure the first end of said interior jamb to said third main frame leg through the use of a screw.

2. A door jamb assembly comprising:

a main frame, said main frame having a face providing a decorative looking surface; said main frame composed of high density polyurethane;

a first main frame end;

a second main frame end;

a main frame lip, said main frame lip having a door jamb engaging face, said main frame lip extending from said second main frame end sufficient to overlap a portion of a door jamb;

a main frame extension, said main frame extension protruding outwardly from said first main frame end, said main frame extension having an end for engaging and supporting a portion of a trim, said main frame extension having a support face for supporting said trim;

a decorative trim, said decorative trim secured to the extension of said main frame;

a fastener guiding hole located on a trim leg, said fastener guiding hole allowing said decorative trim to be laterally connected to said main frame by a fastener; and a member for securing a fastening flange thereto to thereby enable the door jamb assembly to be secured proximate a wall as a unit.

3. The door jamb assembly claimed in claim 2 including a closed-cell foam tape, said foam tape located on a face of a trim lip of said decorative trim, said foam tape is compressible and water resistant and forms a weather proof seal when said trim lip engages a portion of said main frame.

4. The door jamb assembly claimed in claim 2 including a second trim leg, said second trim leg having an end, the end of said second trim leg having an access hole to allow a fastening device access to said fastener.

5. The door jamb assembly claimed in claim 3 in which said member is located either at said first main frame end or located at said second side of said trim leg for securing said flange.

6. The door jamb assembly claimed in claim 4 in which said flange is a nailing flange, said nailing flange composed of vinyl, said nailing flange connectable to a first member or a second member to secure said door jamb main assembly to the wall.

7. The door jamb assembly claimed in claim 6 including an interior jamb having a first end and a second end, said interior jamb having a recess located proximate said first end of said interior jamb to allow said first end of said interior jamb to be secured to a main frame leg by a second fastener.

8. The door jamb assembly claimed in claim 6 wherein said interior jamb is composed of a veneered lumber core.

9. The door jamb assembly claimed in claim 8 wherein said fastener is a screw, said screw securable by a screwdriver.

* * * * *